US007207893B1

(12) United States Patent
Louie

(10) Patent No.: US 7,207,893 B1
(45) Date of Patent: Apr. 24, 2007

(54) GOLF CHIP SHOT PRACTICE DEVICE

(76) Inventor: Matthew Louie, 5046 Meridlen St., Los Angeles, CA (US) 90042

( * ) Notice: Subject to any disclaimer, the term of this patent is extended or adjusted under 35 U.S.C. 154(b) by 0 days.

(21) Appl. No.: 11/332,053

(22) Filed: Jan. 13, 2006

(51) Int. Cl.
*A63B 69/36* (2006.01)

(52) U.S. Cl. ..... 473/166; 473/194

(58) Field of Classification Search ..... 473/163, 473/166, 182–184, 191, 194
See application file for complete search history.

(56) References Cited

U.S. PATENT DOCUMENTS

| | | | | |
|---|---|---|---|---|
| 2,232,569 | A * | 2/1941 | Johnson | 473/191 |
| 3,194,556 | A | 7/1965 | Vinson | |
| 4,025,071 | A * | 5/1977 | Hodges | 473/436 |
| 4,191,374 | A * | 3/1980 | Kulesza et al. | 473/436 |
| 4,249,739 | A * | 2/1981 | Brandell | 473/183 |
| 4,336,939 | A * | 6/1982 | Krumlauf | 473/183 |
| 5,029,867 | A * | 7/1991 | Johnson | 473/191 |
| 5,174,574 | A * | 12/1992 | Knox et al. | 473/183 |
| 5,251,885 | A | 10/1993 | Logan | |
| 5,396,876 | A * | 3/1995 | Liscio et al. | 124/6 |
| 5,417,196 | A * | 5/1995 | Morrison et al. | 124/6 |
| 5,492,319 | A | 2/1996 | Lee | |
| 6,443,859 | B1 * | 9/2002 | Markin | 473/451 |
| 6,569,028 | B1 * | 5/2003 | Nichols et al. | 473/192 |
| 6,849,000 | B2 * | 2/2005 | Chen | 473/161 |
| 7,000,922 | B1 * | 2/2006 | Norton | 273/352 |
| 2002/0107080 | A1 * | 8/2002 | Hsu | 473/191 |

* cited by examiner

*Primary Examiner*—Mark S. Graham
(74) *Attorney, Agent, or Firm*—Lewis Brisbois Bisgaard & Smith LLP; Sanford Astor, Esq.

(57) ABSTRACT

A golf chipping practice device for a golfer comprising, a base, a net enclosure comprising a rear panel and side panels attached to the base, the net being open facing the player, the base having a floor area which is angled downward, a hole in the floor area of the base to receive a ball hit into the net, a power unit inside the base, a channel to carry the ball after it drops into the hole, a switch in the channel adapted to activate a spinning wheel which encroaches into the channel, presses against the ball in the channel and drives the ball forward, an exit hole through which the ball is driven by the spinning wheel back to the player, a switch adjacent the exit hole adapted to turn off the power unit when impacted by the ball exiting the exit hole.

12 Claims, 5 Drawing Sheets

GOLF CHIP SHOT PRACTICE DEVICE

BACKGROUND OF THE INVENTION

Many types of golf practice devices exist in the market today that provide the opportunity to practice aspects of the game of golf. Many devices are available to practice putting, some devices are available to practice driving and some are available to practice chipping. Some of these devices are as large as a modest home and others are no larger than a size of a small drinking cup. The game of golf has grown into global proportions, where countless gismos, gadgets, and apparatus are produced to try to aid the player make improvements in his or her performance.

U.S. Pat. No. 5,492,319, dated Feb. 20, 1996, to Sung C. Lee describes a chip shot practice device whose main objective is safety to the surroundings of the person executing the shot. The device comprises a rectangular safety net, shaped like a wedge, elongated with mesh, the bottom part of the net provides a channel, sloped for a golf ball return system. The golf ball is struck from a location very close to the opening of the net structure, and thus, does not provide any sense of how far the ball would go or the exact trajectory of the shot. About all it provides is a chance to swing a club. In addition, time is needed to construct the apparatus from its put-away mode, using fasteners and screws. At full extension the device is 3 ft high, 5 ft in length and 1 ft in width. This device is not very mobile and a great amount of space is needed to utilize this bulky device.

U.S. Pat. No. 5,251,885, dated Oct. 12, 1993 to Neil Logan, is a drive practice device. Designed mainly for power hitters, this device is capable of catching golf balls driven at tremendous forces and trajectories. The mechanics of this device, for putting to rest the motion of a golf ball hit by a large club, is by a bag attached to a swinging arm. The force of the driven ball urges the bag rearward, out of the way of the club swing and a recoiling spring placed inside of a tube mounted onto a base plate brings the swinging arm hack to its original position. The bag is supported by a rectangular receptacle mounted onto the moveable-recoiling spring tube. As the ball is hit, the bag catches the ball, which rotates the spring causing tension, which helps to stop the motion of the moving ball. Outlets and channels are used then to direct the ball back to the point of execution. Again, the ball is hit from a position very close to the bag device and there is little, if any, opportunity to gauge what would have been the flight or distance of the shot. In addition, the ball is placed on the same spot for each practice shot, producing the same action after each hit. Because of the limiting factors of the design of the device, there is no variable to ball placement and therefore it has only a singular action of play. The mechanics for returning the ball are basically the use of gravity and channels to direct the ball back to the player.

U.S. Pat. No. 3,194,556, dated Jul. 13, 1965, to George R. Vinson, describes a baseball pitcher's aid. This device does not give any information as to its dimensions and one can only guess as to the size of a device needed to catch a moving baseball thrown from a particular distance. The design has a square opening with the middle marked as the strike zone. It has springy wires facing the pitcher, on the outer edges, to mark the ball zone. If the springs are disturbed, it indicates a ball, if undisturbed it indicates a strike. As the ball enters the device, it is stopped by a canvas backing and falls down to a sloped channel, which guilds the ball into a thrower housing. A switch is depressed by the entering ball, to activate an electric motor. The motor rotates a pulley, which drives a belt to rotate gears, which in turn will rotate "springy steel throwers". Tension on a spring is the mechanism for returning the ball to the point of execution. As the ball is ejected from the device the switch comes up automatically, and the device is turned off. The design is bulky and the ball return system is limited to the spring load, as a baseball has a certain amount of weight, therefore ejecting it back to the point of execution X distance away would take a tremendous amount of force. The use of tension from a spring is not a good mechanism for returning balls, and is not adjustable.

BRIEF DESCRIPTION OF THE INVENTION

This invention relates to a golf chipping practice device and more particularly, to a golf chipping practice device embodying a motorized feature, to return the successful targeted golf balls hit into the containment area back to the person who executed the chip shot, by the utilization of an adjustable contact wheel.

OBJECTS OF THE INVENTION

It is an object of the invention is to provide a golf chipping aid which is simple in construction, easy to use, well adapted for its intended purpose and relatively inexpensive to manufacture.

Another object of the invention is to provide a novel golf chipping practice device that:

1. offers different points of execution of shots at different distances from the device.
2. has two modes of returning the ball back to the point of execution in an expeditious manner, a horizontal roll or an air toss.
3. offers an adjustable ball return dial to control the distance of the returning ball
4. can be mobile powered by a changeable, rechargeable internal battery
5. will shut itself off after the execution of a shot
6. is light weight and compact for easy storage.
7. is usable for both the novice and seasoned player
8. is usable for fin as well as game improvement

DETAILED DESCRIPTION OF THE INVENTION

Figure 1:
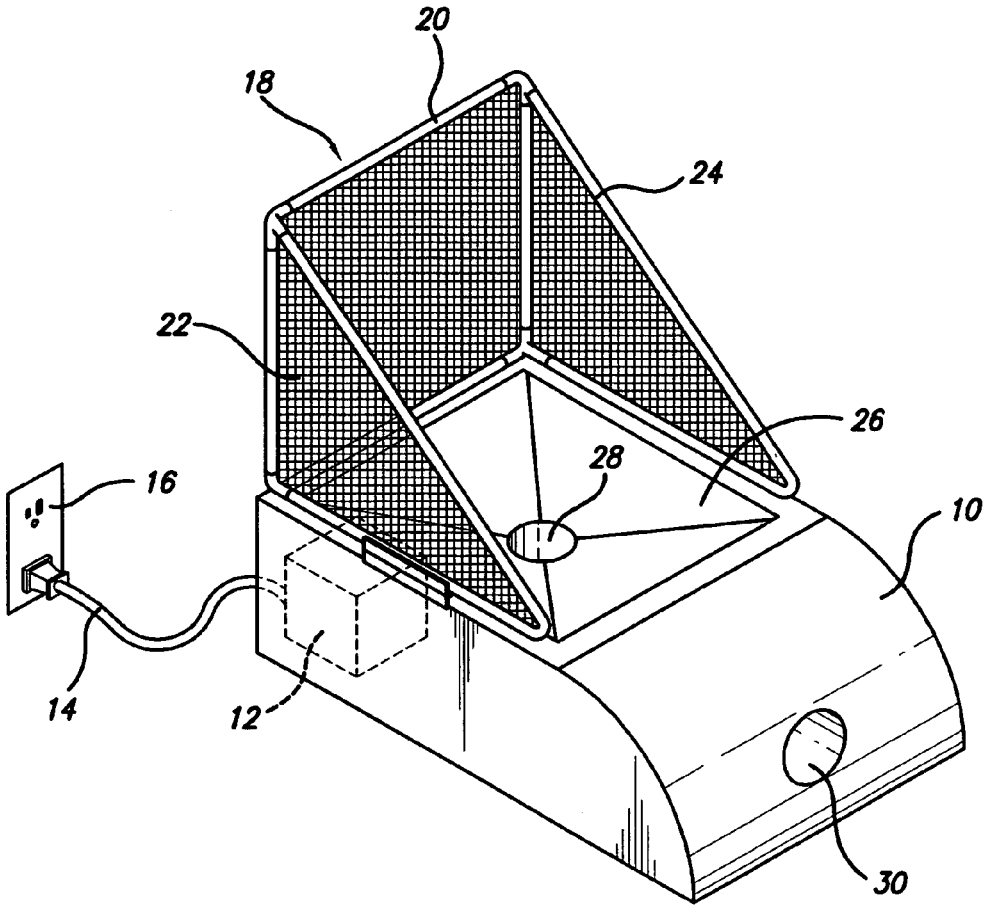
FIG. 1 is a perspective view of one embodiment of this invention.

Referring now to FIG. 1, there is shown, a base 10 of the chipping practice device of the invention, containing a power unit 12, an electric line cord 14 and an electrical plug 16 for plugging into standard 110 voltage, when available.

The unit can be operated by battery power, if a source of electricity is not available at the site where the device is to be used.

A net 18 designed to catch the ball being chipped comprises a rear panel 20 and two side panels 22, 24. There is an opening facing the player, so that the ball will be received between the sections of net 18. Net 18 may be in the shape shown or it may be in any other convenient shape, such as having rectangular sides. Net 18 may also be made taller or it may have side panels which angle outward to catch balls that may be hit slightly off target. The idea is to catch as many balls as possible, although a ball chipped badly off-line will not be caught by the return device of the invention.

Also shown in base 10 is a floor area 26, having an entrance hole 28 through it, preferably in the center of the floor. Floor area 26 is slanted and angled downward toward the hole, so that a ball landing on floor 26 will roll down the angled floor and drop down into hole 28. Hole 28 delivers the ball to a return system, discussed below. Base 10 also has a return hole 30 through which a ball is impelled back to the player. The design in FIG. 1 shows the ball being returned by rolling it back to the player along the ground.

Figure 2A:
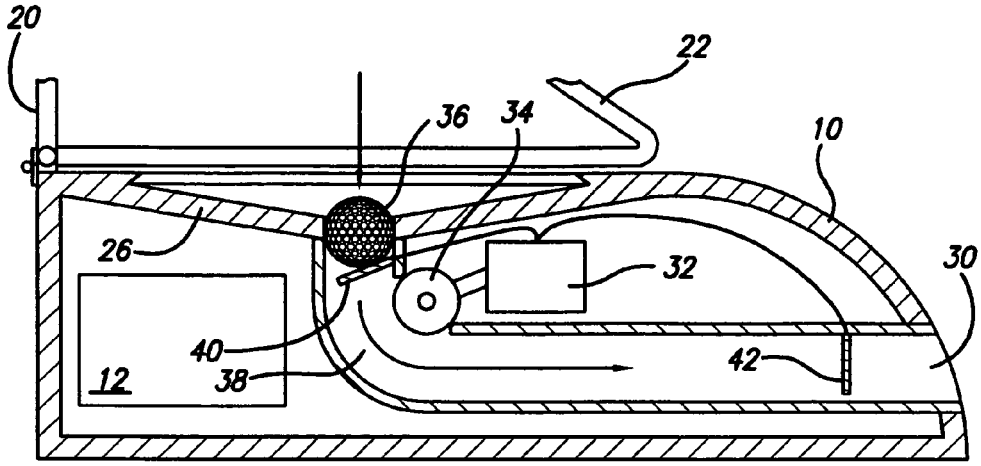
FIGS. 2A, 2B and 2C are cross-sectional side views taken on lines 2—2 of FIG. 1.
Figure 2B:
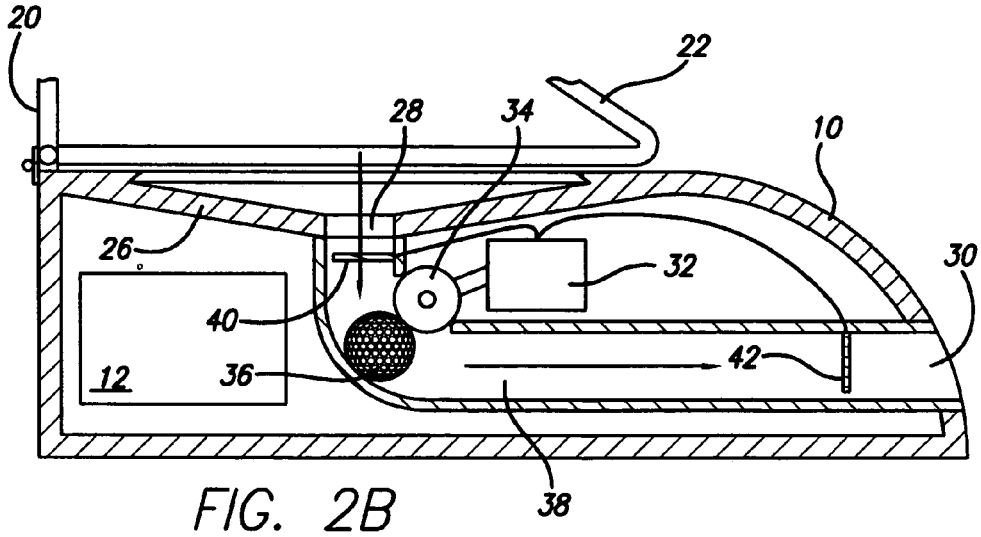
Figure 2C:
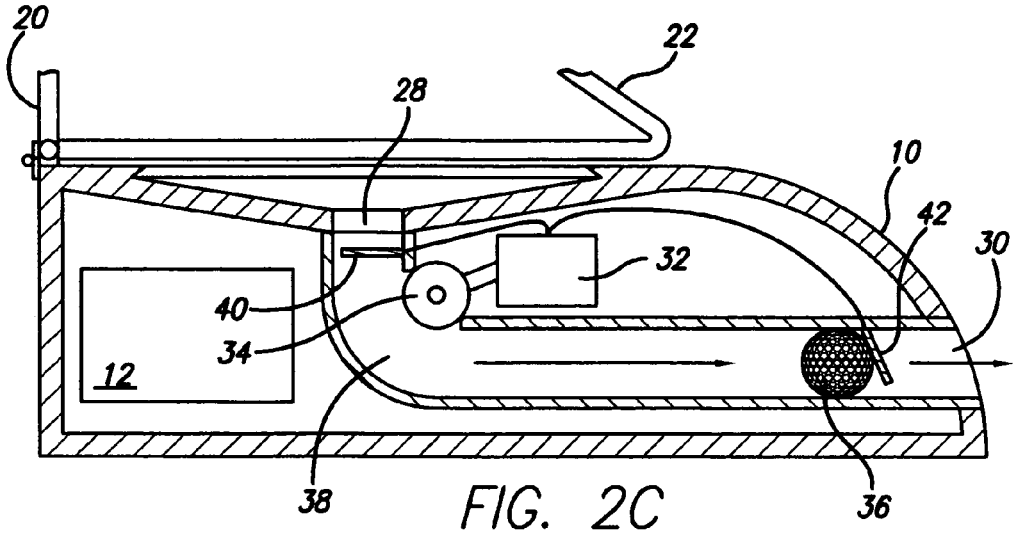

Referring to FIGS. 2A, 2B, and 2C, there is shown base 10 with power unit 12, slanted floor 26 and hole 28. There is also shown a part of side net 22 and rear net 20.

Inside of base 10 is a motor 32, which operates a spinning wheel 34. When a ball 36 is caught in the device and drops through hole 28, ball 36 drops into channel 38. As ball 36 drops it hits and activates switch 40, which causes motor 32 to turn on, activating spinning wheel 34. The diameter of channel 38 is such that spinning wheel 34 encroaches into channel 38 and presses against the outside diameter of ball 36 driving ball 36 forward and out exit hole 30, with some force. On its way out of channel 38, ball 36 hits and activates second switch 42, adjacent exit hole 30, which turns off motor 32. In this way, motor 32 only begins running when a ball drops into hole 28 and hits switch 40 and motor 32 turns off when ball 36 is ejected.

Motor 32 can have an adjustable power control which will, in turn, adjust the speed of spinning wheel 34. This will adjust the distance that ball 36 travels after it exits hole 30. Thus, the player can practice chip shots from varying distances and have the ball returned to the proper location at each distance.

Figure 3:
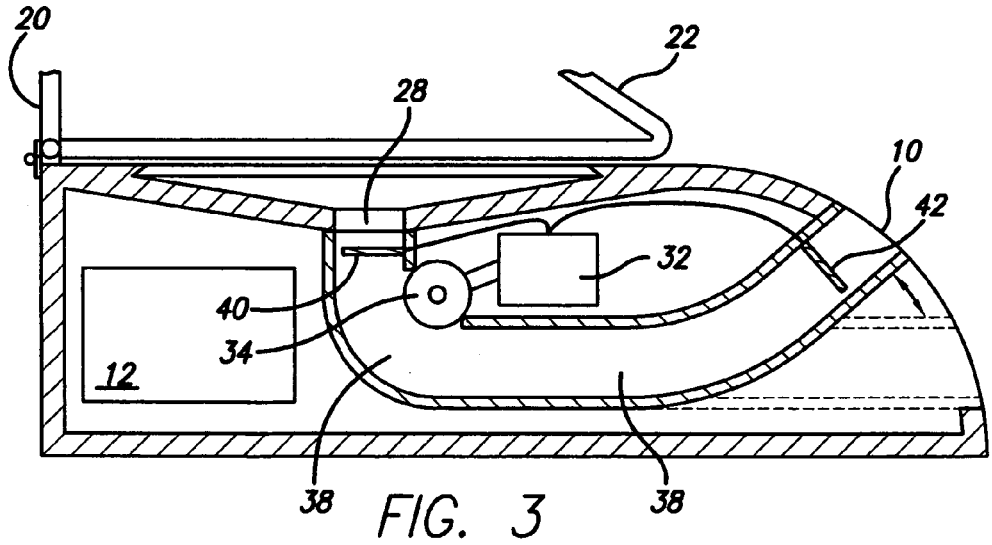
FIG. 3 is a cross-sectional side view of another aspect of the invention.

Referring now to FIG. 3 there is shown another embodiment of the invention in which channel 38 is slanted upward, so that ball 36 is lofted back to the player rather than rolled back along the ground. The return device can either be built to either roll or loft the ball back or, preferable, it can be built with channel 38 being made from an adjustable, bendable material, such as a flexible tubing or corrugated tubing, which can be adjusted to the angle of ejectment desired and holds its shape. In that way the player can adjust the trajectory, the height and distance of ball return, as the player changes distance from the ball return device.

Another optional adjustment that can be utilized is a power control switch or knob on motor 32, which regulates the voltage of the motor, which will control the speed of spinning wheel 34 and thus control the force and distance that ball 36 is thrown out back to the player. This way, the player can practice chip shots from varying distance and adjust the return device to roll or toss the ball back the proper distance to the player. Using a standard motor, operated by 110 volt power or by a 12–24 volt battery, the ball can be rolled or tossed up to 50 feet away, back to the player. Stronger motors can be used to toss the ball even farther. The device of this invention can be used indoors, with care, usually for shorter shots, or in the outdoors.

Figure 4:
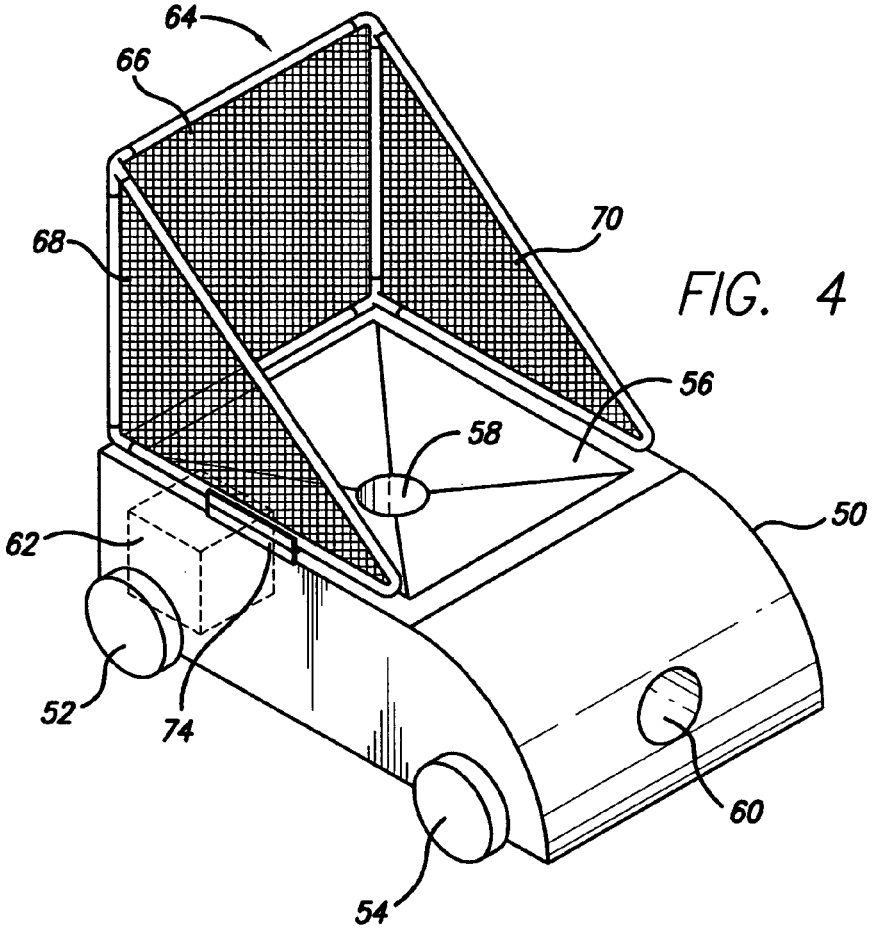
FIG. 4 is a perspective view of another embodiment of this invention with the net up.
Figure 5:
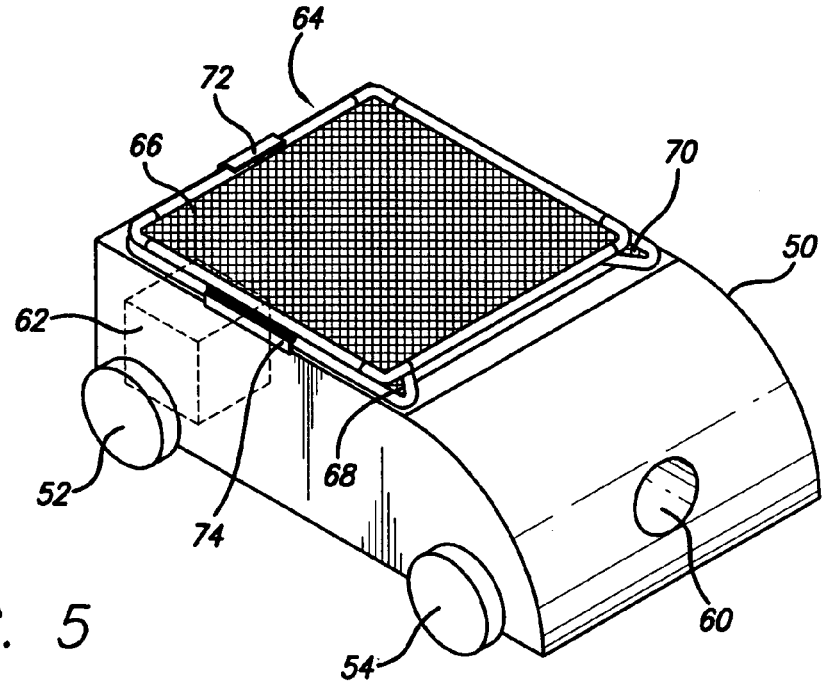
FIG. 5 is a perspective view of another embodiment of FIG. 4 with the net folded down.

Referring to FIGS. 4 and 5 there is shown another embodiment of the invention comprising a base 50, which rides on four wheels 52 and 54 and two wheels on the opposite side of the base, not shown. With wheels, the return device can roll it from one location to another. The inside workings of this embodiment are the same as shown in FIGS. 1–3. There is shown a floor area 56 having a hole 58 through it. The base also has a return hole 60 for return of the ball to the player. A power unit 62 is contained inside of base 50.

Net 64 comprises rear panel 66 and side panels 68 and 70. All three panels can be folded down, each panel having a hinge 72 and 74 and a hinge not shown for panel 70. By having the panels able to fold down, the entire unit can be transported much more easily, such as putting it in the trunk of a car. In addition, the net panels can be removable for easy storage.

Figure 6:
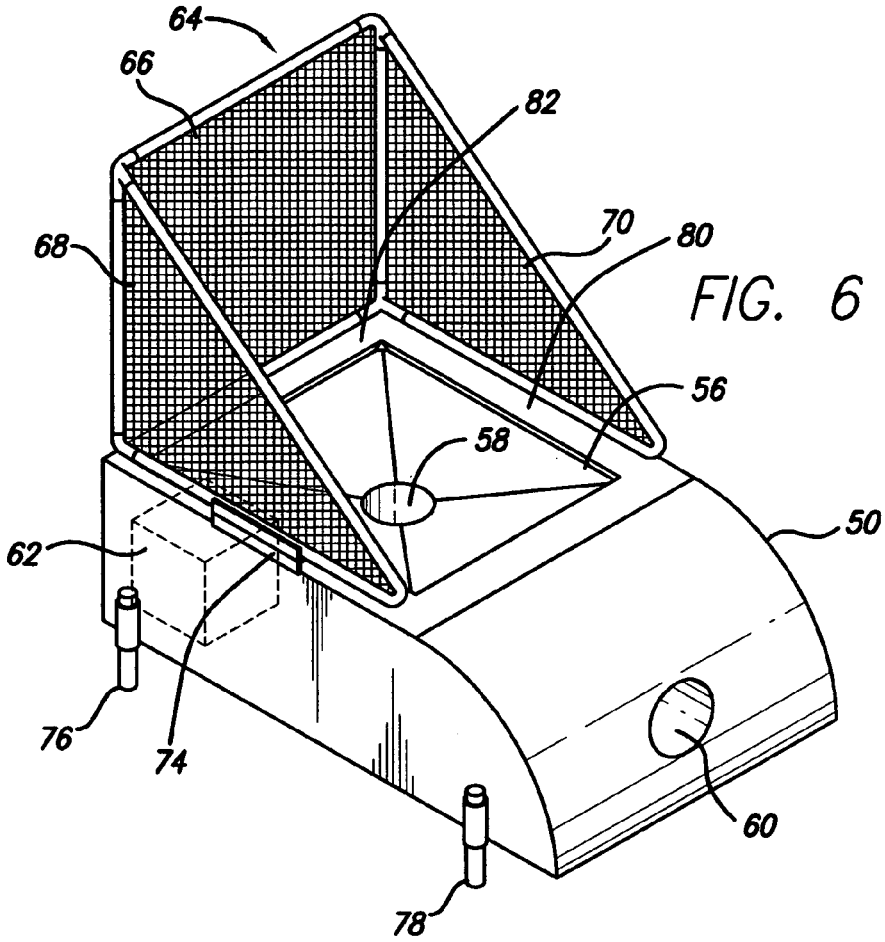
FIG. 6 is a perspective view of another embodiment of this invention with the net up; and, FIG. 7 is a perspective view of the embodiment of FIG. 6 with the net folded down.
Figure 7:
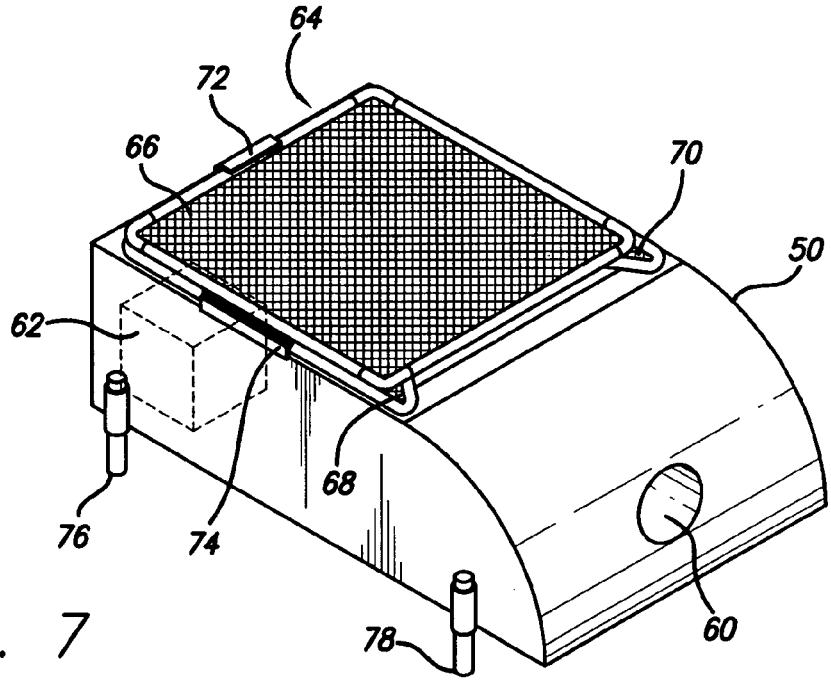

Referring to FIGS. 6 and 7 there is shown another embodiment of the device, which is similar to that shown in FIGS. 4 and 5 but, instead of wheels 52 and 54, has adjustable legs 76 and 78, as well as two adjustable legs on the other side of the device (not shown). The four adjustable legs allow placement of the device on ground which is not completely level, as the legs can be adjusted to make the device sit in a level manner.

In addition, the floor area has rails or bumpers 80 and 82, plus bumpers at the front and left side, not shown, around the perimeter of the floor. The four bumpers, 80, 82 and the two not shown, are similar to bumpers on a pool table and help to prevent balls from bouncing out of the floor of the device, as well as guiding balls into the center of the device.

The net panels can be made of any convenient material such as nylon netting, a soft fabric being preferred to more easily catch the ball and soften its striking the net and the floor of the device. The shape of the netting an also be of any convenient shape such as triangular, rectangular, round or other shapes. The net can also be as tall or short as desired.

For shorter shorts, the device can easily be used inside, especially for more accurate players. For longer shots or for less accurate hitters, outdoors is probably safer, depending upon what is located indoors that might be damaged by an errant shot.

Having thus described the invention, I Claim:

1. A golf chipping practice device for a golfer comprising, a base, a net enclosure: comprising a rear panel and two side panels attached to the base, the net being open facing the player, the base having a floor area which is angled downward, a hole in the floor area of the base adapted to receive a ball hit into the net, a power unit inside the base, a channel to carry the ball after it drops into the hole, a switch in the channel adapted to activate a spinning wheel which encroaches into the channel, presses against the ball in the channel and drives the ball forward, an exit hole through which the ball is driven by the spinning wheel back to the player, a switch adjacent the exit hole adapted to turn off the power unit when impacted by the ball exiting the exit hole.

2. The device of claim 1 in which the channel is adjustable to cause the exiting ball to roll back to the player or be lofted back to the player.

3. The device of claim 2 in which the channel is made from a flexible tubing.

4. The device of claim 1 in which the rear panel and the side panels are hinged to fold down flat against the base.

5. The device of claim 1 in which the base has a plurality of wheels.

6. The device of claim 1 in which the power unit is adjustable to control the speed of the spinning wheel, modifying the distance the ball is returned.

7. The device of claim 1 in which the net side panels are triangular, rectangular or round in shape.

8. The device of claim 1 in which the power unit is operated by battery or external power.

9. The device of claim 1 in which the net panels are removable from the base.

10. The device of claim 1 in which the hole in the floor is in the center of the floor of the base.

11. The device of claim 1 in which the base of the device has a plurality of adjustable legs.

12. The device of claim 1 in which the floor area has bumpers around its perimeter.

* * * * *